US007425164B2

(12) United States Patent
Tanaka et al.

(10) Patent No.: US 7,425,164 B2
(45) Date of Patent: Sep. 16, 2008

(54) PLASMA DISPLAY PANEL MANUFACTURING METHOD

(75) Inventors: Yoshinori Tanaka, Osaka (JP); Junichi Hibino, Kyoto (JP); Masaki Aoki, Osaka (JP); Kazuhiko Sugimoto, Kyoto (JP); Hiroshi Setoguchi, Osaka (JP)

(73) Assignee: Matshushita Electric Industrial Co., Ltd., Osaka (JP)

( * ) Notice: Subject to any disclaimer, the term of this patent is extended or adjusted under 35 U.S.C. 154(b) by 820 days.

(21) Appl. No.: 10/503,316

(22) PCT Filed: Jan. 20, 2004

(86) PCT No.: PCT/JP2004/000413

§ 371 (c)(1),
(2), (4) Date: Aug. 2, 2004

(87) PCT Pub. No.: WO2004/066336

PCT Pub. Date: Aug. 5, 2004

(65) Prior Publication Data

US 2005/0093774 A1 May 5, 2005

(30) Foreign Application Priority Data

Jan. 21, 2003 (JP) ..... 2003-012252

(51) Int. Cl.
*H01J 9/00* (2006.01)
*H01J 9/24* (2006.01)

(52) U.S. Cl. ..... 445/24; 445/23; 445/25; 427/68; 427/64; 427/157; 427/158

(58) Field of Classification Search ..... 445/23–25, 445/50–51, 38, 40–41, 55; 313/582–587; 264/45.1, 45.3; 427/68, 64, 157–158
See application file for complete search history.

(56) References Cited

U.S. PATENT DOCUMENTS

| | | | | |
|---|---|---|---|---|
| 3,564,328 | A * | 2/1971 | Bagley et al. | 313/624 |
| 4,198,585 | A * | 4/1980 | Yamashita et al. | 313/587 |
| 4,203,050 | A * | 5/1980 | Rech et al. | 174/50.5 |
| 5,860,843 | A * | 1/1999 | Kasahara | 445/24 |
| 6,313,578 | B1 * | 11/2001 | Mishra et al. | 313/485 |
| 6,472,819 | B2 * | 10/2002 | Carretti et al. | 313/562 |
| 6,483,238 | B1 * | 11/2002 | Baret et al. | 313/582 |
| 6,603,260 | B1 * | 8/2003 | Kim et al. | 313/562 |

FOREIGN PATENT DOCUMENTS

| | | |
|---|---|---|
| EP | 1 017 083 | 7/2000 |
| JP | 5-59359 | 3/1993 |
| JP | 6-100858 | 4/1994 |
| JP | 6-176700 | 6/1994 |

(Continued)

*Primary Examiner*—Mariceli Santiago
*Assistant Examiner*—José M Díaz
(74) *Attorney, Agent, or Firm*—Wenderoth, Lind & Ponack, L.L.P.

(57) ABSTRACT

A method of manufacturing a plasma display panel is disclosed. The method includes forming at least one of a dielectric layer on a principal face of a substrate, barrier ribs which partition a discharging space on the dielectric layer, and a phosphor layer disposed between the barrier ribs using an inorganic material into which solution including a degassing material is impregnated.

12 Claims, 8 Drawing Sheets

FOREIGN PATENT DOCUMENTS

| | | |
|---|---|---|
| JP | 6-310039 | 11/1994 |
| JP | 8-17365 | 1/1996 |
| JP | 9-115451 | 5/1997 |
| JP | 10-273658 | 10/1998 |
| JP | 2000-215817 | 8/2000 |
| JP | 2000-311588 | 11/2000 |
| JP | 2001-283721 | 10/2001 |
| JP | 2002-75170 | 3/2002 |
| JP | 2002-124177 | 4/2002 |
| JP | 2002-367520 | 12/2002 |
| WO | 00/33347 | 6/2000 |

* cited by examiner

PLASMA DISPLAY PANEL MANUFACTURING METHOD

TECHNICAL FIELD

The present invention relates to a method of manufacturing plasma display panels of plasma display devices to be used for displaying images in television receivers featuring a large screen, thin body and light-weight.

BACKGROUND ART

In recent years, computers and television receivers have employed a variety of color display devices. A plasma display panel (hereinafter simply referred to as "PDP"), among others, has drawn attention as a color display device that allows the display panel to be large-size, thin, and light weight.

A PDP includes the following elements:

- a front plate including a transparent substrate such as a glass substrate, on which display-electrodes, a dielectric layer, and protective film are laminated; and
- a back plate including:
  - a substrate, on which striped address electrodes are formed before a dielectric layer is formed,
  - barrier ribs, for forming a discharging space, disposed on the dielectric layer; and
  - a phosphor layer formed on lateral faces of the barrier ribs and on the dielectric layer, which phosphor layer is excited by ultraviolet rays to emit light in red, green, or blue.

The front and back plates are confronted each other and sealed, then neon (Ne) or xenon (Xe) is filled in the discharging space for discharging. Operating the foregoing PDP generates impurity gas because of the structure discussed above; thus, a degassing material is inserted into the PDP for absorbing and removing the impurity gas. In other words, the degassing treatment is provided. This instance is disclosed in Japanese Patent Application Non-Examined Publication No. 2000-311588. Further, providing the barrier ribs of the PDP with a degassing layer is proposed in Japanese Patent Application Non-Examined Publication No. 2002-531918.

However, the foregoing conventional degassing treatments are problematic. FIG. 8 shows a degassing structure in a conventional PDP. As shown in FIG. 8, back plate 52 is sealed by front plate 50 and sealing member 51. Back plate 52 is provided with exhausting hole 53, to which exhausting pipe 54 is coupled. Pipe 54 is filled with degassing material 55. The foregoing structure allows degassing material 55 to collect impurity gas in the discharging space through exhausting pipe 53. However, because the discharging space in the PDP is separated by barrier ribs 56, the impurity gas does not flow in the space, but diffuses for being collected by degassing material 55. Thus, only the impurity gas only around degassing material 55 is collected, and the impurity gas discharged to the image display area cannot be collected. In order to overcome this problem, exhausting pipes 53 are prepared at plural places on back plate 52, and degassing material 55 is also prepared at plural places. However, this case not only complicates the manufacturing process, but also weakens the strength of back plate 52.

FIG. 9 shows another degassing structure in a conventional PDP. As shown in FIG. 9, the PDP includes back plate 61 and front plate 60 including electrodes and a dielectric body, and a is equipped with degassing layer 64 on the top surface of barrier ribs 63. Degassing layer 64 forms parts of back plate 61, and each one of barrier ribs 63 has phosphor layers 62 on its side walls. Preparation of degassing layer 64 on the top surface of barrier ribs 63 can collect the impurity gas from overall the PDP more effectively. However, after forming barrier ribs 63, degassing layer 64 must be formed again and, thus, so that the manufacturing process becomes complicated. Further, the degassing material impairs the insulation property of barrier ribs 63, which affects the discharging characteristics.

On top of the foregoing problems, the conventional degassing material shown in FIGS. 8 and 9 needs to be heated at as high as approx. 400° C. to become activated.

The present invention aims to provide a method of manufacturing PDPs in which impurity gas can be collected from overall the PDP without an activation treatment at a high temperature.

BRIEF DESCRIPTION OF THE INVENTION

The method of manufacturing plasma display panels of the present invention comprises:

- forming a dielectric layer on a principal face of a substrate;
- forming barrier ribs on the dielectric layer for partitioning a discharging space; and
- forming a phosphor layer between the barrier ribs.

At least one of the above steps uses inorganic material that has undergone an impregnation process where solution including degassing material is impregnated into the inorganic material.

DETAILED DESCRIPTION OF THE INVENTION

Exemplary embodiments of the present invention are demonstrated hereinafter with reference to the accompanying drawings.

Exemplary Embodiment 1

A method of manufacturing PDPs in accordance with the first exemplary embodiment of the present invention is demonstrated hereinafter with reference to the related drawings.

Figure 1:
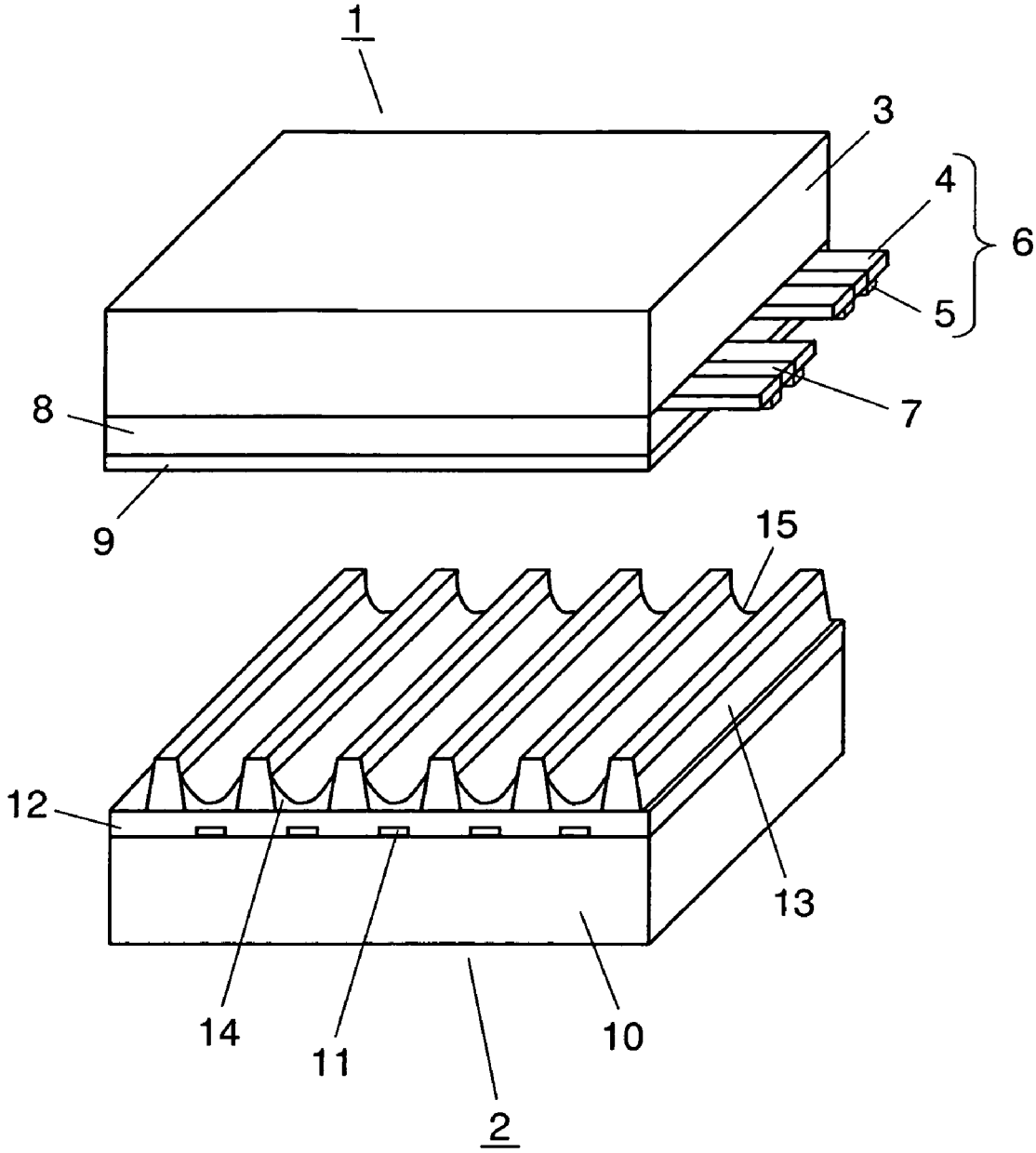
FIG. 1 shows an exploded perspective view illustrating a PDP in accordance with the present invention.

A structure of the PDP of the present invention is described with reference to FIG. 1. The PDP is basically formed of front plate 1 and back plate 2. Front plate 1 comprises the following elements:

- front glass substrate 3;
- display electrodes 6 formed on a first principal face of substrate 3, including striped transparent electrodes 4 and bus electrodes 5;
- light-proof layers 7 formed on the first principle face of substrate 3;
- a dielectric layer 8, covering display electrodes 6 and light-proof layers 7, for working as a capacitor; and
- protective layer 9 made of magnesium oxide (MgO) and formed on dielectric layer 8.

On the other hand, back plate 2 comprises the following elements:

- a back glass substrate 10;
- striped address electrodes 11 formed on a first principal face of back glass substrate 10;
- back-plate dielectric layer 12 covering address electrodes 11;
- barrier ribs 13 formed on dielectric layer 12; and
- phosphor layers 14 formed between respective barrier ribs 13 for emitting lights in red, green and blue.

The PDP is produced by air-tightly sealing front plate 1 and back plate 2 facing each other with address electrodes 11 intersecting with display electrodes 6 at right angles. Discharging space 15 formed by barrier ribs 13 is filled with a discharge-gas such as neon (Ne) or xenon (Xe) at a pressure of 400-600 Torrs. An application of a given voltage to display electrodes 6 and address electrodes 11 discharges discharge-gas, and the resultant ultraviolet ray excites phosphor layers 14 of the respective colors, so that the phosphor emits lights in red, green and blue. A color image is thus displayed.

Figure 2:
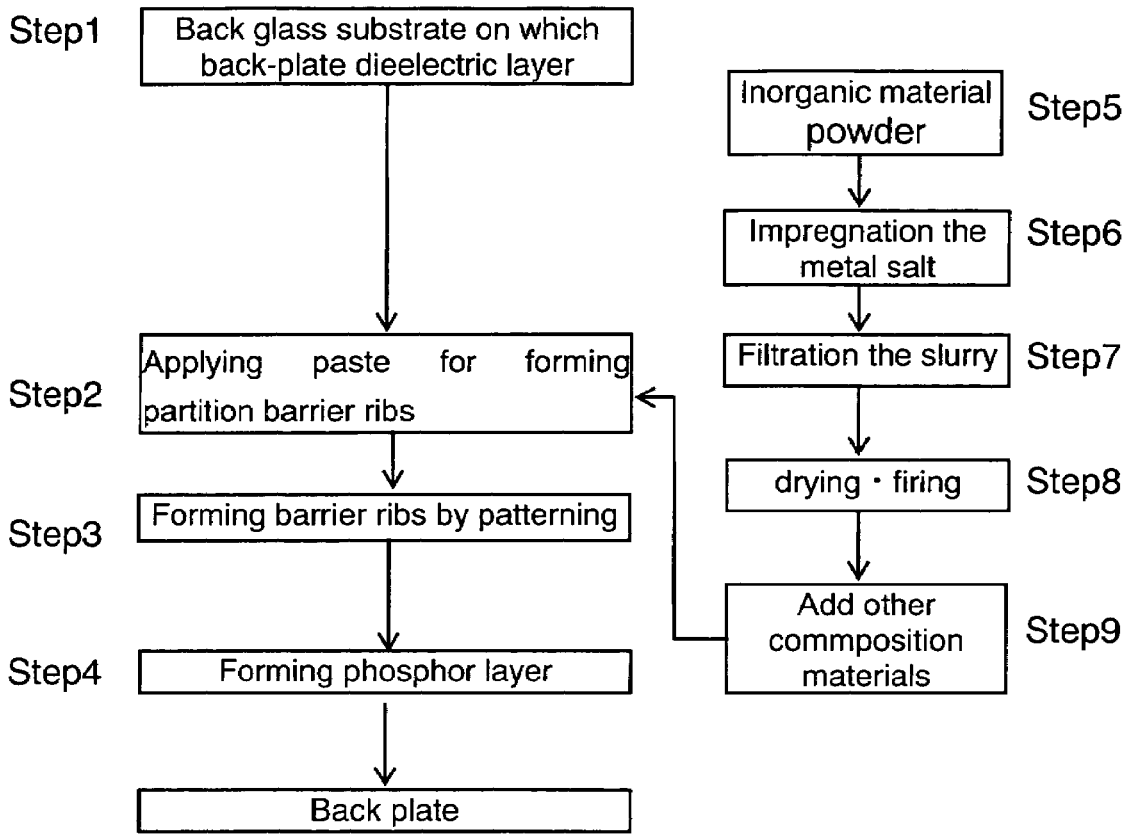
FIG. 2 shows a process flowchart describing a process where partition material is impregnated with degassing material in accordance with a first exemplary embodiment of the present invention.

In this first embodiment, barrier ribs 13 of the PDP discussed above are absorb and collect impurity gas. FIG. 2 is a flowchart showing a process of forming barrier ribs 13 on back glass substrate 10 on which address electrodes 11 and back-plate dielectric layer 12 are formed. The process includes the steps of:

- step 1: preparing back glass substrate 10 on which back-plate dielectric layer is formed;
- step 2: applying paste onto glass substrate 10 to prepare for forming barrier ribs 13;
- step 3: forming barrier ribs 13 by patterning; and
- step 4: forming phosphor layers 14 on barrier ribs 13 and back-plate dielectric layer 12.

The process of producing the paste to be used for forming barrier ribs 13 includes step 5-step 9, as shown in FIG. 2.

First, in step 5, powder particles of inorganic material such as silica or aluminum oxide which is principal material of barrier ribs 13 are prepared. The purity of silica or aluminum oxide must be carefully selected from the standpoint of mechanical strength of barrier ribs 13. In the case of using aluminum oxide, θ or γ model crystal is preferably selected because of its greater specific surface area. This selection is useful in step 6 where metal salt is impregnated into inorganic material, and particularly, if it is necessary to impregnate a large amount of metal salt into aluminum oxide.

Next, in step 6, the metal salt of degassing material is impregnated into the inorganic material. The metal component of the metal salt (degassing material) can be any metals as long as they are in high activity state. For example, nickel (Ni), zirconium (Zr), iron (Fe), vanadium (V), chrome (Cr), or molybdenum (Mo) can be used. Among those metals, at least one metal can be used. A salt group of those metals can be, for example, an acetate group, a nitrate group, or a oxalate group. The metal salts are solved in pure water, and the inorganic material prepared in step 5 is added to the resultant solution of 1-4% density. This solution is agitated for approximately 2 hours for impregnating the metal salt solution into the inorganic material. Slurry is thus produced.

Next, in step 7, filtrate the slurry undergone the impregnation is filtrated. Sucking filtration is preferable for removing water completely between particles. Next, in step 8, the slurry is dried and baked for drying moisture as well as decompositing and removing the salt group. For drying moisture, 150-300° C. is preferable, and oxygen atmosphere at 350-600° C. is preferable for decompositing and removing the salt group. Nitrogen atmosphere or reducing gas atmosphere such as hydrogen can be used depending on the situation. Steps 5 through 8 completes impregnation of the degassing material into silica or aluminum oxide, namely, principal material of barrier ribs 13. In other words, the process from step 5 to step 8 produces inorganic material into which the solution including the degassing material is impregnated. In step 8, acetate group, nitrate group, oxalate group are selected for decompositing and removing the salt group; however, the salt group may remain in some cases, so that a hydrochloric acid group, a phosphoric acid group or a formic acid group can be used. Further, an organic complex or an inorganic complex can also be used without question.

Figure 3A:
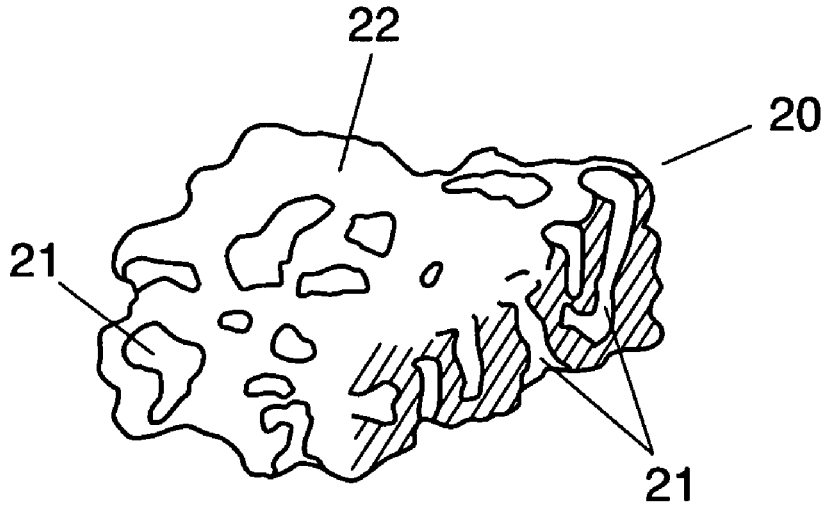
FIGS. 3(*a*) and 3(*b*) show schematic drawings illustrating interior structures of particles of inorganic material in accordance with the first exemplary embodiment of the present invention.
Figure 3B:
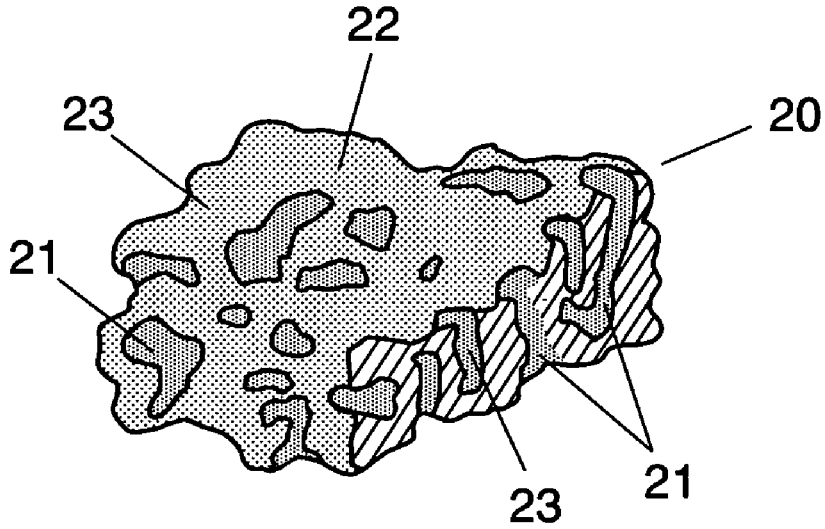

FIG. 3 shows schematically an interior structure of the inorganic material particle to which the degassing material impregnated. As shown in FIG. 3(*a*), particle 20 of the inorganic material, such as silica or aluminum oxide, has pores 21 having a diameter of several tens Å or several thousands Å, depending on its crystal state or starting material. Impregnation of the degassing material into particles 20 having pores 21 of the inorganic material allows fine particles 23 of the degassing material to attach onto an inner face of pores 21 or outer surface 22 of particles 20 as shown in FIG. 3(*b*). Such fine particles 23 of several tens Å across or several hundreds Å across have high catalytic activity because of their small crystal diameters. On top of that, they can produce catalytic effect of several hundreds times that of the conventional degassing material, and they work as gas absorbing members. The small crystal diameter increases surface energy, so that not only physical adsorption but also chemical adsorption occurs. As a result, the degassing material can collect impurity gas without activation treatment, which has been required with the conventional degassing materials.

In step 9, an additional material of barrier rib 13 is added to the inorganic material to which the degassing material is impregnated, namely, glass component of low melting point is added, as shown FIG. 2. Resin and solvent are then added in order to form paste. The glass component of low melting point refers to, e.g. Pb—B based glass (compound of PbO—ZnO—$B_2O_3$—$Al_2O_3$—$SiO_2$). The paste is applied onto back glass substrate 10, on which back-plate dielectric layer 12 is formed, in several hundreds μm depth by a screen printing method or die-coating method. Then the applied paste is dried for removing the solvent. An optimum material can be added to the paste in response to the method of patterning barrier ribs 13 in step 3. For instance, when a photolitho method is used for patterning barrier ribs 13, photosensitive material is added to the paste.

In step 3, barrier ribs 13 are patterned. Besides the foregoing photolitho method, a sand-blast method and lift-off method are available for the patterning. In the case of using the screen printing method, the paste produced in step 9 is directly printed on the pattern, so that step 2 is omitted. After the patterning, the pattern is baked at approx. 500° C. for removing the resin component from the paste and solidifying. Barrier ribs 13 in a given shape are thus produced.

In step 4, phosphor layer 14 are formed on both of lateral faces of barrier ribs 13 and back-plate dielectric layer 12. Phosphor layers 14 of three colors, i.e. red, green and blue, are formed by a method such as the screen printing method or the ink-jet method.

The steps discussed above form back plate 2, which is then bonded to front plate 1 which is produced separately, such that display electrode 6 of front plate 1 intersects with address electrode 11 of back plate 2 at right angles, and the bonded unit is sealed at its periphery. Then the bonded unit is heated and exhausted for removing the impurity gas generated and collected during the manufacturing process, and predetermined discharge gas is inserted into the unit before sealing. The PDP is thus completed.

In the foregoing PDP, impurity gas is generated at phosphor layer 14 and front plate 1 by the discharge of the PDP. The impurity gas is absorbed physically and chemically by fine particles of the degassing material in barrier ribs 13, which degassing material features high activity and is excellent in gas absorption performance. Since barrier ribs 13 are formed all over the display area of the PDP, the impurity gas all over the display area can be evenly absorbed. It is known that a large amount of the impurity gas occurs from phosphor layer 14, so a function of collecting impurity gas provided to barrier rib 13 adjacent to this gas source increases the effect of gas collection. Therefore, the PDP can maintain the discharge gas of given ingredients and at a given density, and the PDP can always discharge in a stable manner. A PDP excellent in discharging characteristics is thus obtainable.

Figure 4:
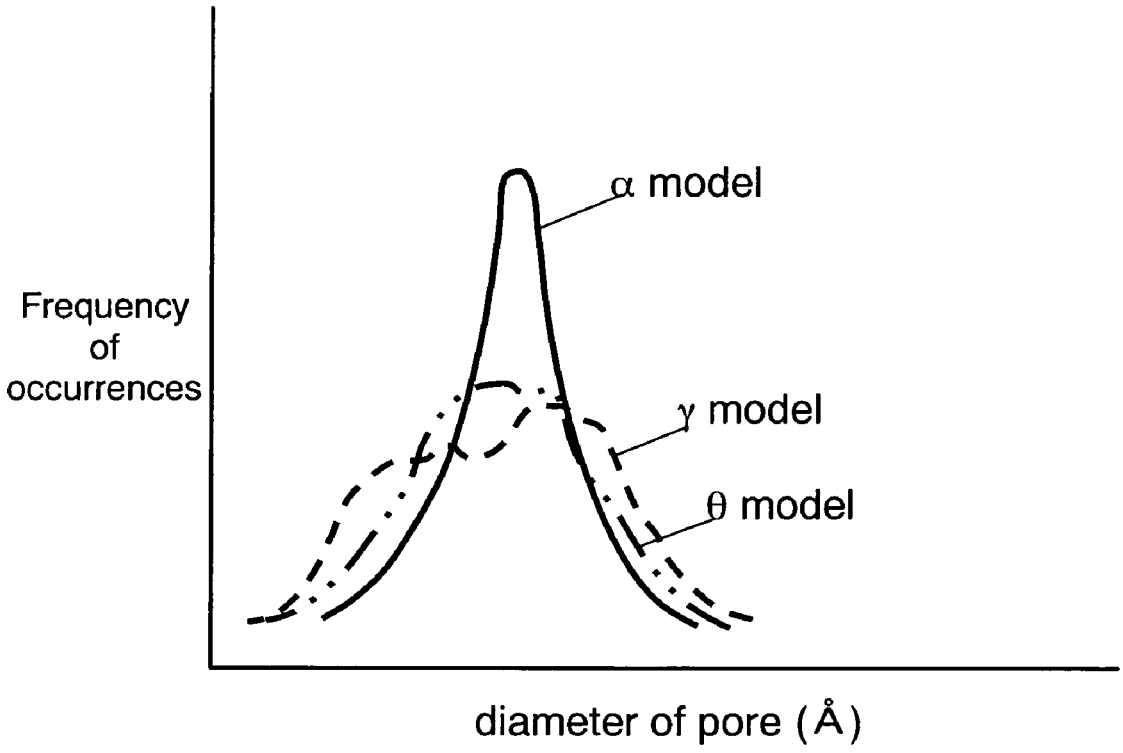
FIG. 4 shows a distribution of pores in an aluminum oxide crystal.

Selection of γ model aluminum oxide or θ model aluminum oxide as the inorganic material for barrier rib 13 allows forming a barrier rib more excellent in collecting the impurity gas. FIG. 4 shows schematically the differences in distributions of pores depending on the crystal states of aluminum oxide. The lateral axis represents a diameter of pores (Å), and the vertical axis represents a frequency of occurrences. As shown in FIG. 4, the number of θ model pores having smaller diameters is greater than that of α model pores, and the number of γ model pores having smaller diameters is greater than that of θ model pores. Impregnation of the metal salt, the degassing material, into those pores forms fine particles of the degassing material. In this case, the smaller diameter of a pore becomes, the smaller diameter of a fine particle is produced, so that the specific surface area substantially increases, which accompanies a substantial increase of gas absorption activity. Therefore, the selection of γ or θ model aluminum oxide substantially increases collection of the impurity gas.

Exemplary Embodiment 2

The second exemplary embodiment of the present invention refers to the case where phosphor layer 14 is equipped to absorb and collect the impurity gas.

Figure 5:
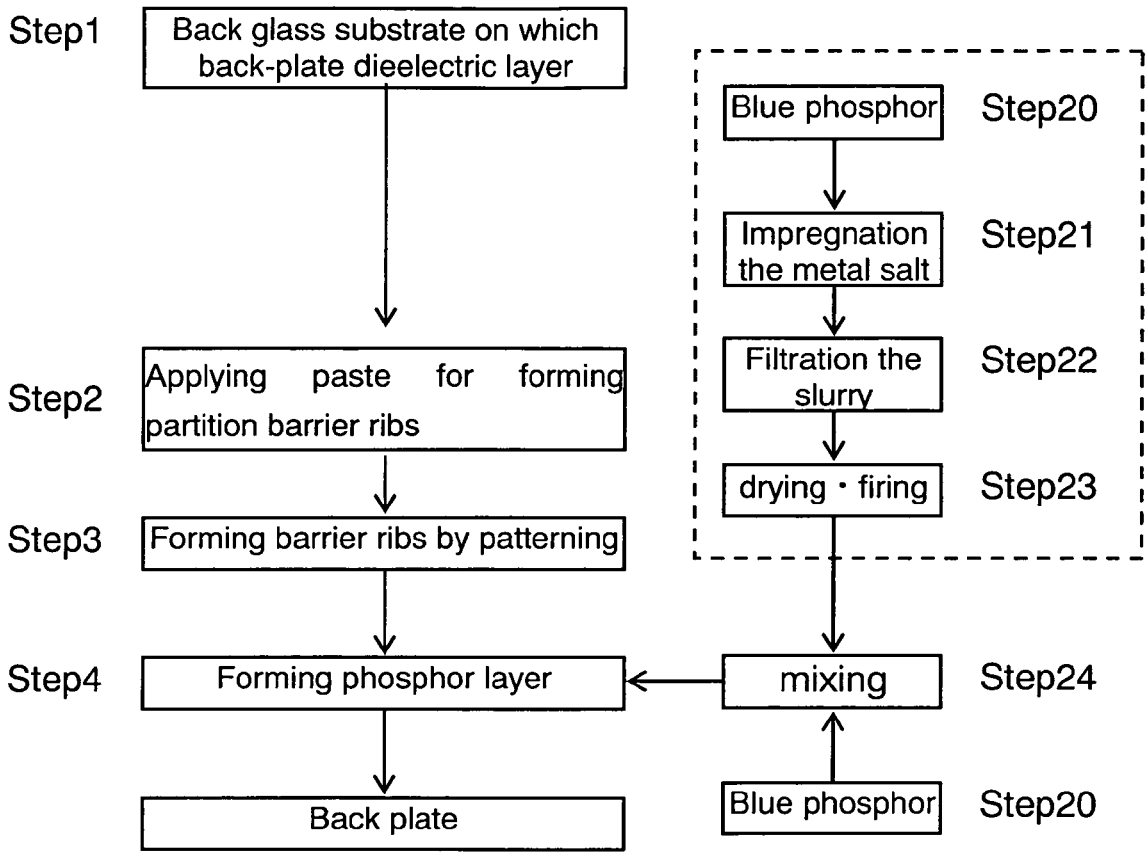
FIG. 5 shows a process flowchart describing a process where phosphor material is impregnated with the degassing material in accordance with a second exemplary embodiment of the present invention.

FIG. 5 shows a flowchart describing the process of producing a phosphor paste by impregnating the degassing material into inorganic material of a phosphor layer, as well as the process of forming the phosphor layer using the phosphor paste. In this embodiment, blue phosphor, i.e. BAM:Eu phosphor is used as an example.

In step 20, the blue phosphor (BAM:Eu) is prepared. The blue phosphor is compounded by, first, preparing the following materials in stoichiometrically adequate quantity: aluminum oxide, barium carbonate, and magnesium carbonate as the base material, europium as the activation agent, and a bit of aluminum fluoride as the flux agent that facilitates movement between the materials at partial melting on surface of each material as well as accelerates reactions. Then, the above materials are missed and baked at a high temperature. The baked materials are classified for obtaining powders of a given diameter.

In step 21, the degassing material is impregnated into the phosphor material or inorganic material separately added. In this embodiment, metal salt as the degassing material is impregnated into parts of the phosphor powders produced as discussed above. Metal components (degassing material) of the metal salt can be anything as long as they are high activation materials, e.g. at least one metal out of nickel (Ni), zirconium (Zr), iron (Fe), vanadium (V), chrome (Cr), and molybdenum (Mo). The salt group of those metal salts can be, for example, an acetate group, a nitrate group, or an oxalate group. The metal salts are solved in pure water, and the phosphor powders are added to the resultant solution of 1-4% density. This solution is agitated for approx. 2 hours for impregnating the metal salt solution into the phosphor powders. Slurry is thus produced.

Next, in step 22, the slurry undergone the impregnation is filtrated. Sucking filtration is preferable for removing water completely between molecules. Next, in step 23, the slurry is dried and baked for drying moisture as well as decompositing and removing the salt group. For drying moisture, 150-300° C. is preferable, and oxygen atmosphere at 350-600° C. is preferable for decompositing and removing the salt group. Nitrogen atmosphere or reducing gas atmosphere such as hydrogen can be used depending on the situation.

In step 24, the original phosphor powders and the phosphor powders undergone the impregnation are mixed together. Solvent is added to the resultant phosphor powders to form paste, and the paste is applied between barrier ribs 13 by the screen printing method or the inkjet method. In step 23, acetate group, nitrate group, oxalate group are selected for decompositing and removing the salt group; however, the salt group may remain in some cases, so that a hydrochloric acid group, a phosphoric acid group or a formic acid group can be used. Further, an organic complex or an inorganic complex can be used without question.

The phosphor powders prepared in step 20 have pores of several tens Å-several thousands Å across. Impregnation of the degassing material into these phosphor powders having the foregoing pores allows fine particles of several tens Å-several hundreds Å across of the degassing material to attach onto the inner wall of the pores or the outer surface around the pores. Such fine particles of the degassing material have high catalytic activity because of their small crystal diameters. On top of that, they have a structure similar to that can produce catalytic effect of several hundreds times that of the conventional degassing material, and they work as gas absorbing members. The small crystal diameter increases surface energy, so that not only physical adsorption but also chemical adsorption occurs. As a result, the degassing material can collect impurity gas without an activation treatment, which has been required with conventional degassing materials. The impregnation of the degassing material into only small parts of the original phosphor powders thus allows absorbing and collecting of the impurity gas. Therefore, the impurity gas can be collected free from degrading the characteristics of the phosphor.

In this embodiment, parts of the phosphor material are processed before mixing them with the unprocessed phosphor material. However, aluminum oxide or silica independent of the phosphor material can undergo the impregnation, and be mixed with the phosphor material. Further, a percentage of impregnation is adjusted for applying to the entire phosphor material instead of partial application.

In this embodiment, the blue phosphor undergoes the impregnation for absorbing and collecting the impurity gas; however, the impregnation can be applied to red or green phosphor.

Exemplary Embodiment 3

The third exemplary embodiment of the present invention refers to a case where back-plate dielectric layer 12 is equipped to absorb and collect the impurity gas.

In step 1, shown in FIG. 2, a glass substrate having the back-plate dielectric layer is produced, and inorganic material of back-plate dielectric layer 12 is impregnated with degassing material for producing dielectric paste. This method is described hereinafter.

With dielectric layer 8 of front plate 1 careful attention must be paid to the changes in permeability and dielectric constant due to the ingredients; however, back-plate dielectric layer 12 does not need such careful attention. Thus, selection of material, such as inorganic material, e.g. silica or aluminum oxide, impregnated with metal salt of degassing material, can be done with ease. The method of impregnation is similar to the method of impregnation to barrier ribs 13 in the first embodiment. The material undergone the impregnation is mixed with a glass component having a low melting point and being a principal material of back-plate dielectric layer 12. Then, resin and solvent are added to the resultant material to form paste.

The paste is applied onto back glass substrate 10 by the screen printing method or the die-coating method. The resultant glass substrate 10 is dried and baked to form back-plate dielectric layer 12. Layer 12 thus includes highly active fine particles similar to barrier ribs 13 or phosphor layer 14, and can absorb and collect the impurity gas well.

As discussed in the first embodiment through the third embodiment, the present invention allows the PDP to become excellent in collecting impurity gas by impregnating the materials of the barrier ribs, phosphor layer, or back-plate dielectric layer with the degassing material.

Figure 6:
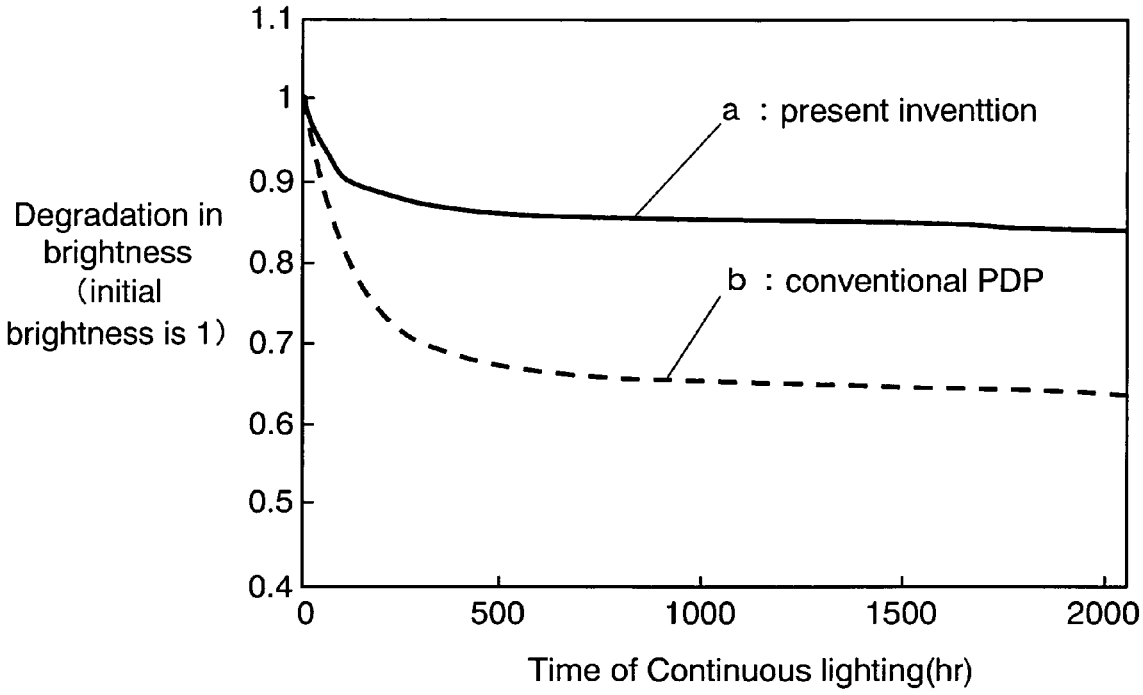
FIG. 6 shows characteristics illustrating time-dependent changes in blue brightness in the case of continuous lighting of a plasma display device.

FIG. 6 illustrates time-dependent changes in blue brightness in the case of continuous lighting of a plasma display device with initial brightness 1. Curve "a" shows the case of a plasma display device employing 42-inch PDP (Lib-pitch=150 μm and in accordance with the HD-TV specification) of which barrier ribs 13 are formed by the method described in the second embodiment. Curve "b" shows the case of a plasma display device employing a conventional PDP in which degassing material is provided in an exhausting pipe and undergoes the activation treatment for absorbing and collecting the impurity gas. The PDP described in curve "a" neither provides the degassing material to the exhausting pipe nor requires an activation treatment. All the other elements the PDPs are the same.

The PDP is filled with neon (Ne)-xenon (Xe; content is 5%) at a charged pressure of 500 Torrs. Discharging space 15, shown in FIG. 1, generates vacuum ultraviolet ray of 147 nm which excites the phosphor, thereby emitting blue light of 450 nm. FIG. 6 shows the changes in brightness of blue light among others because BAM:Eu based blue phosphor is vulnerable to the impurity gas generated in the plasma display panel, and its brightness is degraded substantially.

As shown in FIG. 6, the plasma display device of the present invention shows less degradation in brightness than the conventional device. The impurity gas in the discharging space occurs mainly at an initial stage after turn-on. However, the PDP of the present invention can absorb the impurity gas by using fine particles of the highly active degassing material formed in pores in the inorganic material prepared in the barrier ribs. The blue phosphor layer is thus prevented from being degraded. Measurement of gas components in the panel after 2000 hours of continuous operation indicates that $H_2O$ vapor of a conventional PDP increases by as much as 77% from the initial amount; however, that of the PDP of the present invention increases by only 27%. In the case of HC-based gas (including O), the conventional PDP increases 63% from the initial amount, and that of the PDP of the present invention increases by only 28%. This measurement indicates that the PDP of the present invention has better effect of collecting impurity gas than the conventional one, and shows less degradation in brightness under continuous lighting.

FIG. 6 shows the case of the first embodiment, where the inorganic material impregnated with solution including the degassing material is used for building the barrier ribs. As the second and third embodiments prove, the inorganic material impregnated with solution including the degassing material can be used for building phosphor layer 14 or back-plate dielectric layer 12 with a similar advantage to that of the first embodiment.

Figure 7A:
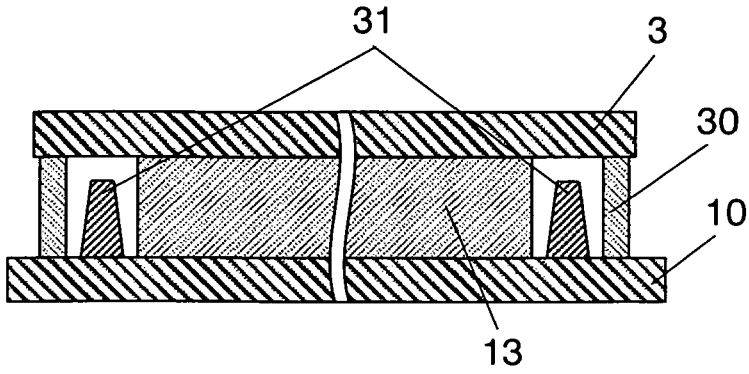
FIGS. 7(*a*) and 7(*b*) show a schematic sectional view and a schematic plan view of another PDP in accordance with an exemplary embodiment of the present invention.
Figure 7B:
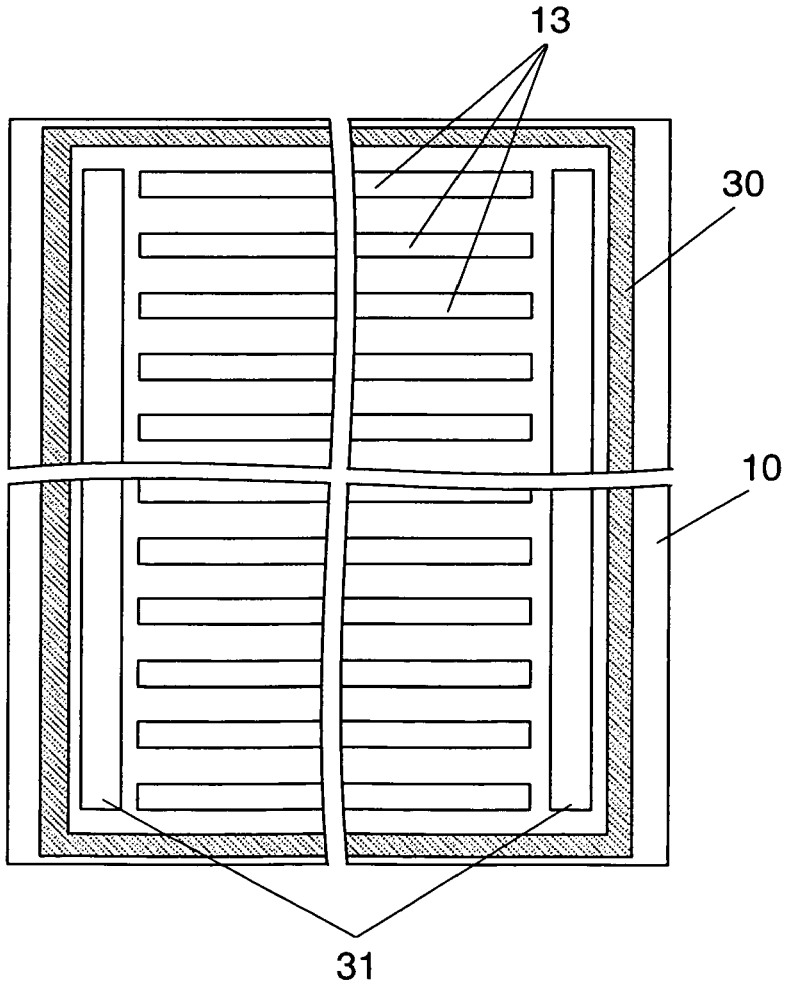
Figure 8:
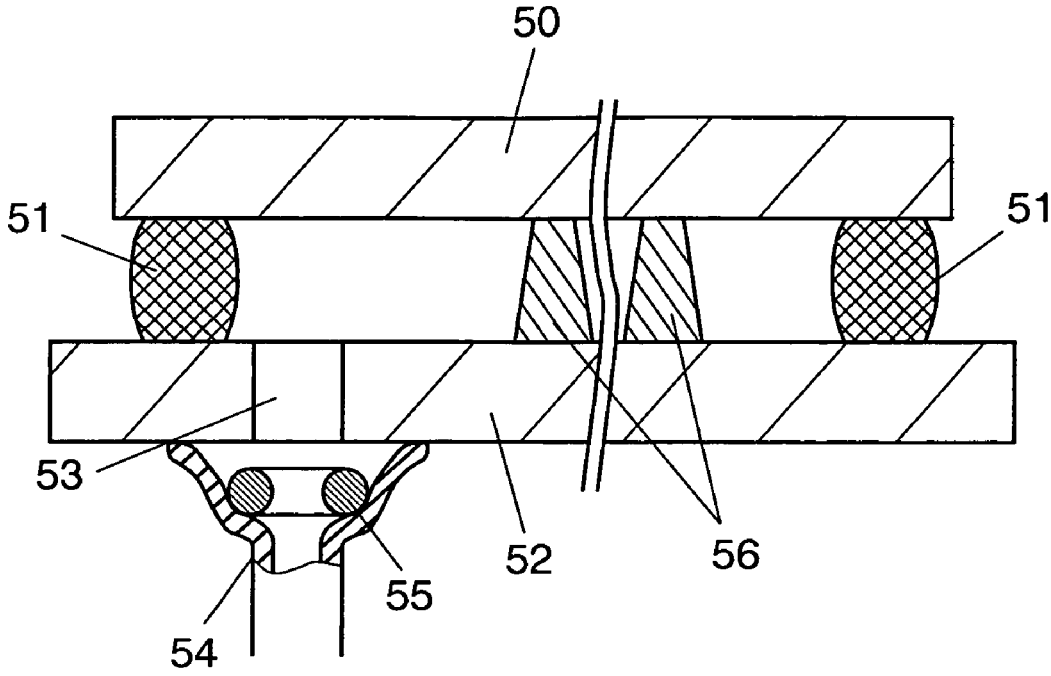
FIG. 8 shows a partial sectional view of a conventional PDP in which degassing material is prepared in an exhausting pipe.
Figure 9:
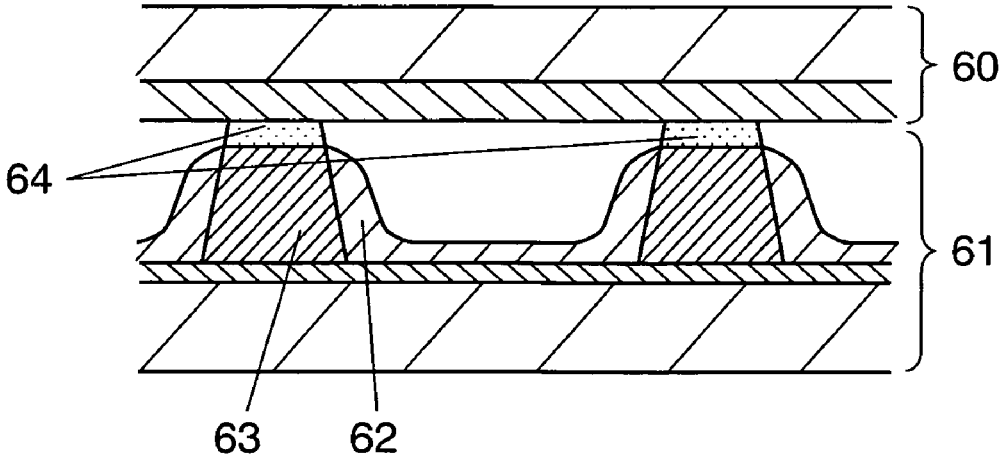
FIG. 9 shows a sectional view of a conventional PDP in which a degassing layer is prepared at an upper section of barrier ribs.

In the first embodiment, barrier ribs 13 are equipped with the function of absorbing and collecting the impurity gas. However, dummy partitions independent of barrier ribs 13 can be prepared, and the same function can be provided to these dummy partitions. FIG. 7 shows an example of this case. FIG. 7(*a*) shows a schematic sectional view of the PDP, and FIG. 7(*b*) shows a schematic plan view of back glass substrate 10 of which electrodes etc. are omitted in this drawing. As shown in FIG. 7, front glass substrate 3 and back glass substrate 10 are sealed at their periphery by sealant 30. Barrier ribs 13 for partitioning the discharging space are disposed on back glass substrate 10, and dummy partitions 31 are formed on back glass substrate 10 between sealant 30 and barrier ribs 13. In other words, dummy partitions 31 are formed at edges of back glass substrate 10. These dummy partitions 31 are formed of the inorganic material impregnated with solution including the degassing material, and can be built in a similar way with similar materials to those discussed for building barrier ribs 13 in the first embodiment. Dummy partitions 31 work as gas adsorption members similar to barrier ribs 13. In the case shown in FIG. 7, since dummy partitions 31 are formed almost all over the longitudinal sides of the PDP, partitions 31 can collect the impurity gas generated in the panel almost all over the longitudinal sides of the PDP. In this case, barrier ribs 13, phosphor layer 14 and back-plate dielectric layer 12 can be made of the same materials as those of the conventional PDP, or at least one of those elements can be formed of the materials and by the methods discussed in embodiments 1-3.

In the embodiments previously discussed, the inorganic material impregnated with solution including the degassing material is used for building some elements of back plate 2 of the PDP. However, the effect of absorbing and collecting the impurity gas can be obtained by providing the face of front plate 1 exposed to the discharging space with a member formed of the foregoing inorganic material.

The invention claimed is:

1. A method of manufacturing a plasma display panel (PDP) comprising:

forming a dielectric layer on a principal face of a substrate;

forming barrier ribs which partition a discharging space on the dielectric layer; and forming a phosphor layer between the barrier ribs, wherein said forming of the phosphor layer comprises a process using an inorganic material or a phosphor material into which a solution including a degassing material is impregnated.

2. The method of claim 1, wherein said forming of the phosphor layer comprises utilizing the inorganic material, and the inorganic material is one of silica and aluminum oxide.

3. The method of claim 1, wherein the solution including the degassing material is impregnated into the inorganic or the phosphor material by an impregnating process comprising:

forming a slurry by impregnating a solution including a metal salt having a degassing material into the inorganic material or the phosphor material;

filtering the slurry to form a filtered slurry; and drying and baking the filtered slurry.

4. The method of claim 3, wherein the metal salt comprises at least one of nickel (Ni), zirconium (Zr), iron (Fe), vanadium (V), chrome (Cr) and molybdenum (Mo).

5. A method of manufacturing a plasma display panel (PDP) comprising:

forming a dielectric layer on a principal face of a substrate;

forming barrier ribs which partition a discharging space on the dielectric layer;

forming a phosphor layer between the barrier ribs, and forming dummy partitions at edges of the substrate, wherein said forming of the dummy partitions at edges of the substrate uses an inorganic material formed by an impregnating process in which a solution including a degassing material is impregnated, wherein said impregnating process comprises:

forming a slurry by impregnating a solution including a metal salt having a degassing material into the inorganic material;

filtering the slurry to form a filtered slurry; and drying and baking the filtered slurry.

6. The method of claim 5, wherein the inorganic material is one of silica and aluminum oxide.

7. The method of claim 5, wherein the metal salt comprises at least one of nickel (Ni), zirconium (Zr), iron (Fe), vanadium (V), chrome (Cr) and molybdenum (Mo).

8. A method of manufacturing a plasma display panel (PDP) comprising:

forming a dielectric layer on a face of a substrate;

forming barrier ribs which partition a discharging space on the dielectric layer; and forming a phosphor layer between the barrier ribs, wherein at least one of said forming of the dielectric layer, said forming of the barrier ribs, and said forming of the phosphor layer includes using θ model aluminum oxide or γ model aluminum oxide into which a solution including a degassing material is impregnated.

9. A method of manufacturing a plasma display panel (PDP) comprising:

forming a dielectric layer on a principal face of a substrate;

forming barrier ribs which partition a discharging space on the dielectric layer;

forming a phosphor layer between the barrier ribs; and forming dummy partitions at edges of the substrate, wherein said forming of the dummy partitions at edges of the substrate includes using θ model aluminum oxide or γ model aluminum oxide into which a solution including a degassing material is impregnated.

10. A method of manufacturing a plasma display panel (PDP) comprising:

forming a dielectric layer on a face of a substrate;

forming barrier ribs which partition a discharging space on the dielectric layer;

forming a phosphor layer between the barrier ribs; and forming dummy partitions at edges of the substrate, wherein at least one of said forming of the dielectric layer and said forming of the barrier ribs includes using an inorganic material formed by an impregnating process in which a solution including a degassing material is impregnated, wherein said impregnating process comprises:

forming a slurry by impregnating a solution including a metal salt having a degassing material into the inorganic material;

filtering the slurry to form a filtered slurry; and drying and baking the filtered slurry.

11. The method of claim 10, wherein the inorganic material is one of silica and aluminum oxide.

12. The method of claim 10, wherein the metal salt comprises least one of nickel (Ni), zirconium (Zr), iron (Fe), vanadium (V), chrome (Cr) and molybdenum (Mo).

* * * * *